US008671710B2

(12) United States Patent
Bae et al.

(10) Patent No.: US 8,671,710 B2
(45) Date of Patent: Mar. 18, 2014

(54) VENTILATION DEVICE AND THE REFRIGERATOR HAVING THE SAME

(75) Inventors: Jun Ho Bae, Seoul (KR); Soo Kwan Lee, Seoul (KR); Chang Joon Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 1509 days.

(21) Appl. No.: 12/061,204

(22) Filed: Apr. 2, 2008

(65) Prior Publication Data

US 2008/0256971 A1 Oct. 23, 2008

(30) Foreign Application Priority Data

Apr. 4, 2007 (KR) ..... 10-2007-0033427

(51) Int. Cl.
*F25D 17/04* (2006.01)
*F25D 21/14* (2006.01)

(52) U.S. Cl.
USPC ..... 62/408; 62/285

(58) Field of Classification Search
USPC ..... 62/408, 407, 411, 285, 288, 291, 283
See application file for complete search history.

(56) References Cited

U.S. PATENT DOCUMENTS

| | | | | |
|---|---|---|---|---|
| 2,349,059 | A * | 5/1944 | Matson et al. | 62/280 |
| 6,497,112 | B1 * | 12/2002 | Simeone et al. | 62/407 |
| 6,497,113 | B1 * | 12/2002 | Yamada et al. | 62/441 |
| 2004/0099000 | A1 | 5/2004 | Jung et al. | 62/285 |
| 2005/0152781 | A1 * | 7/2005 | Baek et al. | 415/206 |

FOREIGN PATENT DOCUMENTS

| | | |
|---|---|---|
| EP | 1 550 811 A2 | 7/2005 |
| KR | 1999-0024052 | 7/1999 |
| KR | 10-2000-0055582 | 9/2000 |
| KR | 10-2002-0006940 | 1/2002 |
| KR | 10-2002-0009658 | 2/2002 |
| KR | 10-2006-0005195 | 1/2006 |

OTHER PUBLICATIONS

PCT International Search Report dated Jul. 20, 2009.
Korean Notice of Allowance dated May 30, 2008.

* cited by examiner

*Primary Examiner* — Cassey D Bauer
(74) *Attorney, Agent, or Firm* — KED & Associates LLP

(57) ABSTRACT

A ventilation device of a refrigerator is configured to prevent freezing of condensed water. The condensed water does not accumulate at the corresponding portion, and hence formation of ice is prevented. The generation of noise and the change of the efficiency of the ventilation fan do not occur, and the risk of ice contacting the shroud of the ventilation fan is reduced and reliability may be improved.

20 Claims, 7 Drawing Sheets

VENTILATION DEVICE AND THE REFRIGERATOR HAVING THE SAME

CROSS-REFERENCE TO RELATED APPLICATIONS

This application claims the benefit of Korean Patent Application No. 10-2007-0033427, filed on Apr. 4, 2007, which is hereby incorporated by reference.

BACKGROUND

1. Field of the Disclosure

The disclosure relates to a ventilation device and a refrigerator.

2. Discussion of Related Art

Generally, a refrigerator is an apparatus capable of storing food or other items to be cooled or frozen for a long time at low-temperature state. Cold air is supplied by means of a refrigerating cycle device including a compressor and a heat exchanger, etc., and provided to a cooling compartment, a cold compartment and/or a freezing compartment. Such a refrigerator is provided with a storage capable of receiving foods, or other items inside of a body, and a machine part including a cooling device generating the cold air to cool the inside of the refrigerator. A ventilation device provides the generated cold air to a cooling requiring space through a given cold air channel. However, such ventilation device has various problems related to water condensation and efficiency.

BRIEF DESCRIPTION OF THE DRAWINGS

The embodiments will be described in detail with reference to the following drawings in which like reference numerals refer to like elements wherein.

DETAILED DESCRIPTION OF THE EMBODIMENTS

Figure 1:
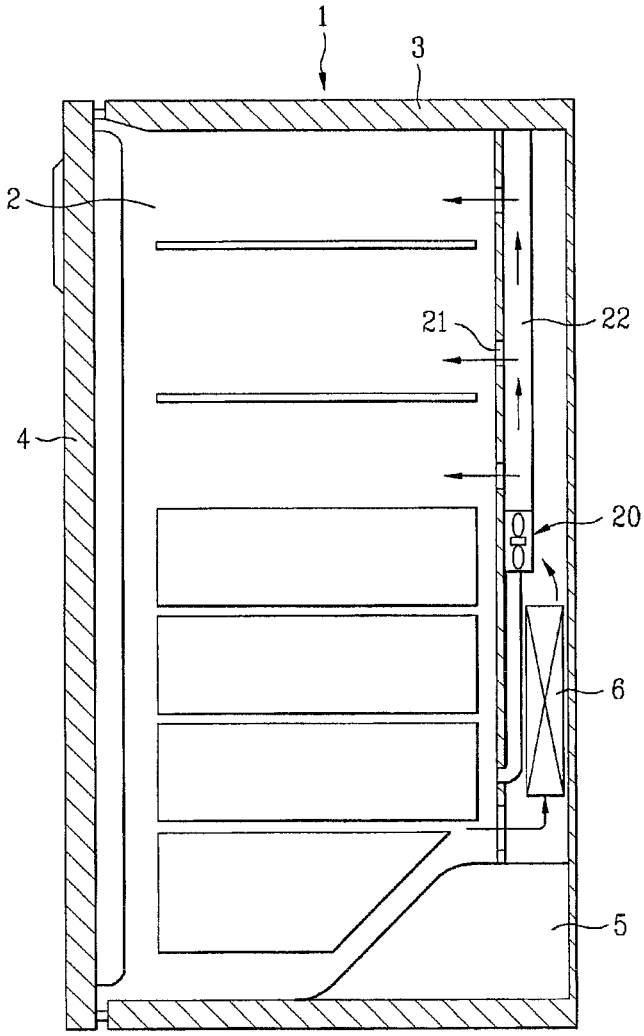
FIG. 1 is a cross-sectional view illustrating the longitudinal section of a refrigerator having an ventilation device of an embodiment.

Referring to FIG. 1, a refrigerator 1 according to an embodiment comprises a storage 2 capable of receiving foods or other items inside of a body 3, a door 4 configured to open and close to allow access to the storage 2, and a machine compartment 5 provided with a machine part such as a compressor. One side of a storage 2 is provided with a cold air channel 22 guiding cold air generated by means of a cooling device such as an evaporator 6 to the storage 2. A ventilation device 20 provides the generated cold air to the cold air channel 22 and the cold air to the storage 2 through outlets 21.

Figure 2A:
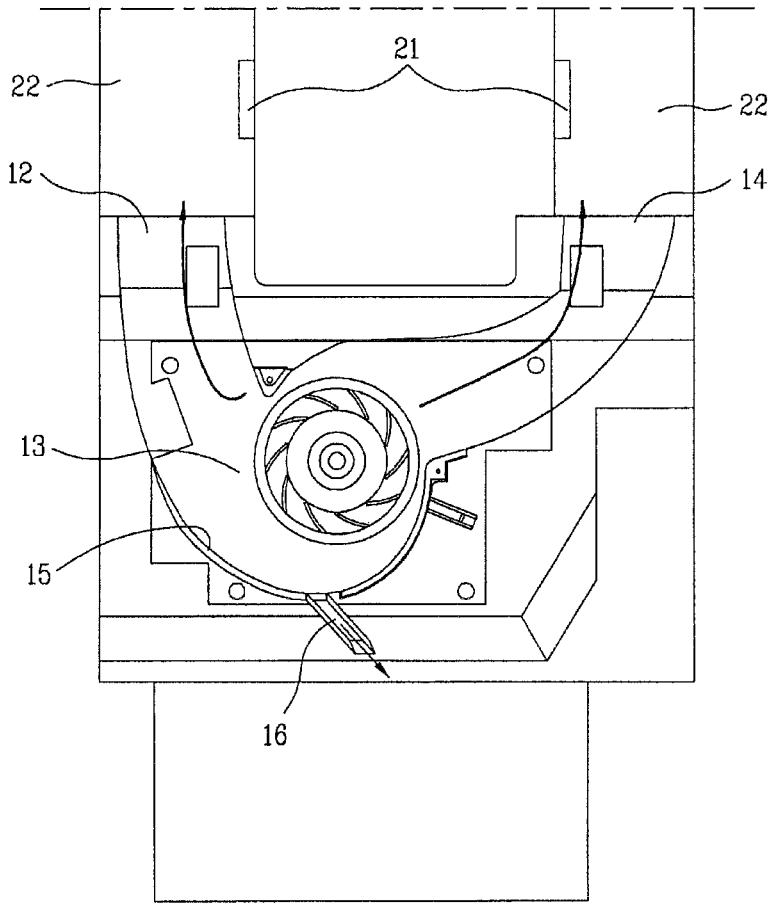
FIGS. 2A-2C are views illustrating one embodiment of the ventilation device according to an embodiment.
Figure 2B:
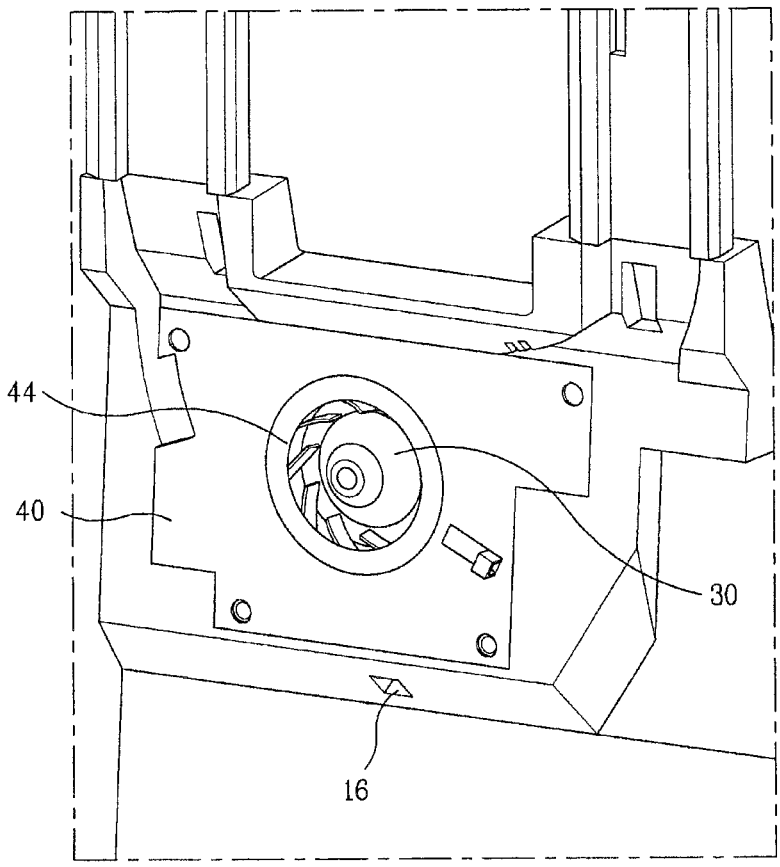
Figure 2C:
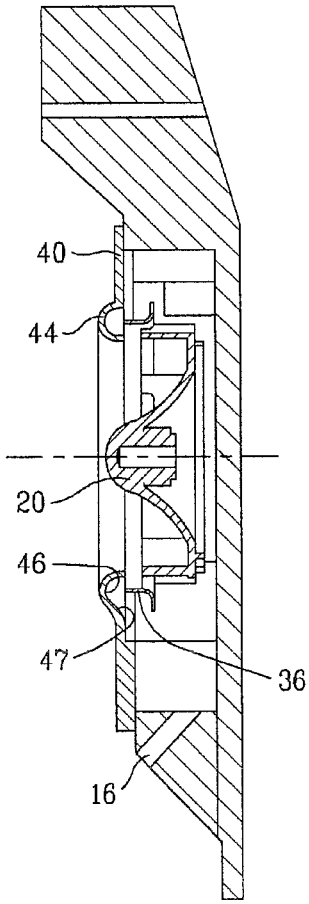

Referring to FIGS. 2A-2C, the ventilation device 20 according to an embodiment comprises a ventilation fan 13, a first duct 12 and a second duct 14 through which air discharged from the ventilation fan 13 flows, and a scroll 15 provided with the ventilation fan 13. A drainage channel 16 allows draining of water, which may be formed by condensation The ventilation fan 13 is configured to suck cold air cooled from the evaporator 6 (refer to the FIG. 1) of a cooling cycle device, and the cold air is discharged to the inside of the scroll 15. A portion of the cold air discharged from the ventilation fan 13 flows through the first duct 12, and the remaining cold air flows through the second duct 14.

The first duct 12 and the second duct 14 may be arranged to provide the cold air discharge from the ventilation device 20 to the same storage 2. If so, the first duct 12 and the second duct 14 are arranged to be provided on both sides of the refrigerator. Alternatively, the ducts can also be arranged to provide air to different storages, respectively. A plurality of ducts allows the inside of the refrigerator to be uniformly cooled.

Figure 3A:
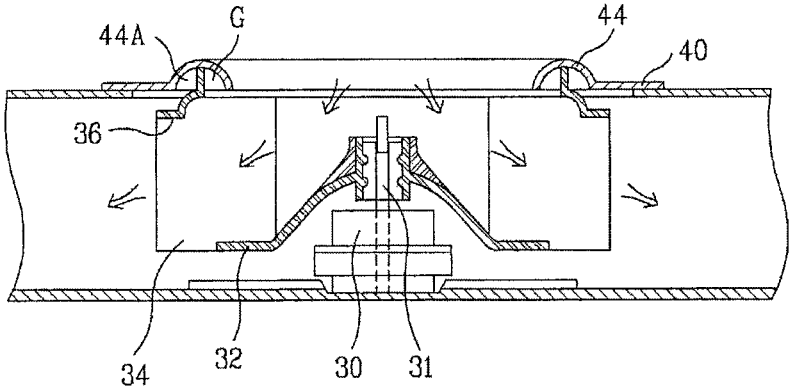
FIGS. 3A-3B are enlarged views of the fan.
Figure 3B:
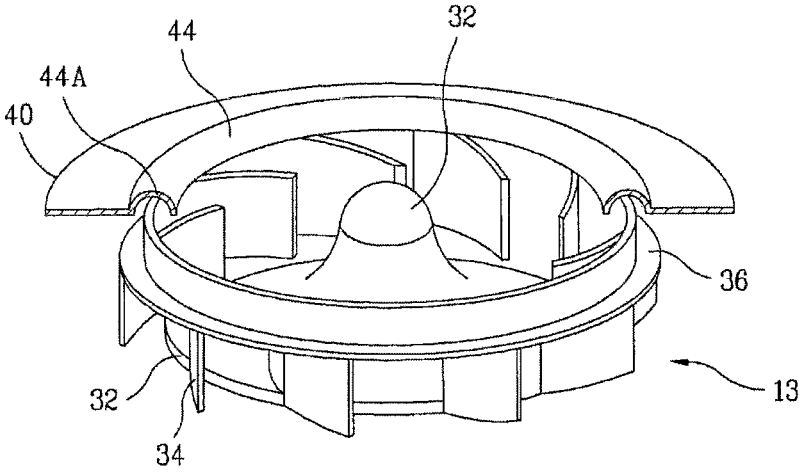

FIGS. 3A and 3B illustrate the details of the ventilation fan 13. The ventilation fan 13 may include a hub 32 connected via a rod 31 to a motor 30 generating the force of rotation, a ring-shaped shroud 36 arranged to be axially spaced from the hub 32, and a plurality of blades 34 radially arranged between the shroud 36 and the hub 32. The shroud 36 may be formed in a ring-shaped structure in order to be able to connect the outside ends of the plurality of the blades 34 to each other, and is formed to be protruded by a predetermined length in the direction of air suction, as shown by the arrows. The ventilation fan 13 sucks the air in an axial direction through the opened portion of the shroud 36 and discharges the air in a radial direction. A scroll 15, or a curved shaped structure or any other means guides the discharged air to first and second air ducts 12 and 14, which guides the cold and/or cool air to the storage 2.

A cover 40 covers the scroll 15, as shown in FIG. 2B. In addition, a portion of the cover 40 corresponding to the ventilation fan 13 has an annular rim 44 in a circular form so that the air can be sucked into the ventilation fan 13. Moreover, the inner circumference surface of the annular rim 44 curves gradually narrow in its inner diameter as proceeding to the shroud 36 to smoothly guide the sucked air.

Figure 4:
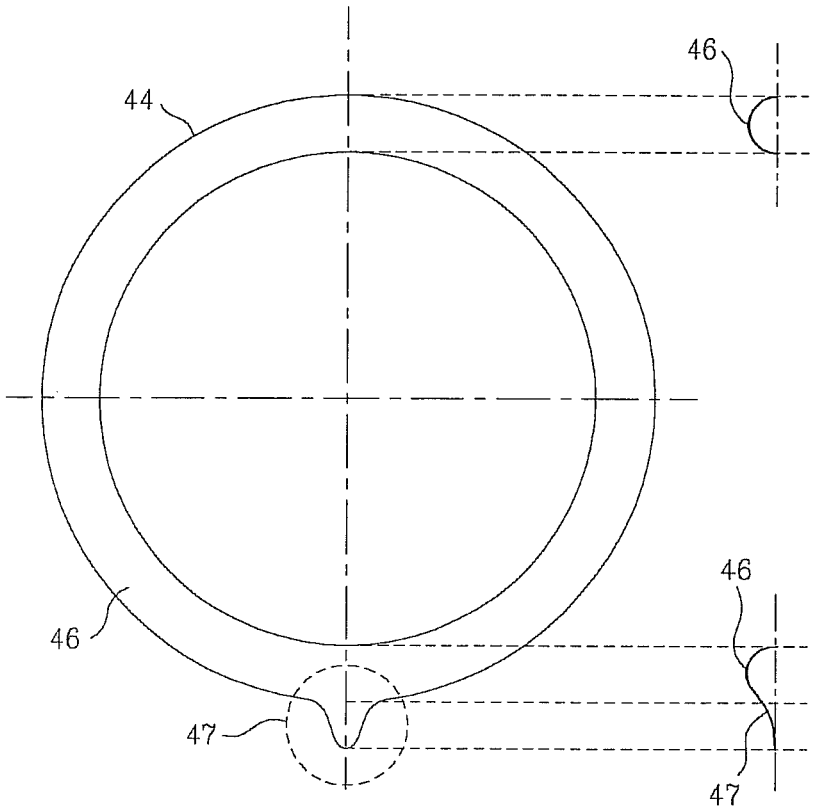
FIG. 4 is a plan view of annular rim with an illustration of section profile according to an embodiment.

The inside surface 44A of the annular rim 44 facing the shroud 36 can be formed in the form of a groove 46 to surround the protruded portion of the shroud 36 in an almost semi-circular form while forming a predetermined gap G with the protruded portion of the shroud 36. The circumference of the annular rim 44 is protruded in a substantially semi-circular form to the outside thereof so that the groove 46 is formed in the inside thereof. FIG. 4 illustrates the inside surface 44A and side profile of the groove 46. The bottom portion 47 of the groove 46 is inclined.

The axis of rotation of the ventilation fan 13 can be arranged in a direction substantially parallel with ground, and the annular rim 44 can be arranged in a substantially vertical direction to the ground. When the cooling cycle operation of a cooling device ends, the moisture of the air inside of the scroll 15 may condense so that the condensed water can be formed in the inside surface of the groove 46 of the annular rim 44.

Since the annular rim 44 is arranged in a substantially vertical direction to the ground, the condensed water formed in the inside surface of the groove 46 of the annular rim 44 flows along the groove 46 to be collected at the bottom portion 47 of the groove 46. As shown, the bottom portion 47 is inclined to the direction of gravity to allow the condensed water to flow down to the bottom of the scroll 15 to be discharged through the drainage channel 16. Since the condensed water is not collected in the inside surface of the groove 46 of the annular rim 44, formation of ice is prevented. The surface area of the groove in which the inclined bottom portion 47 is formed, can be different in proportional to the degree that the condensed water may be formed.

Figure 5:
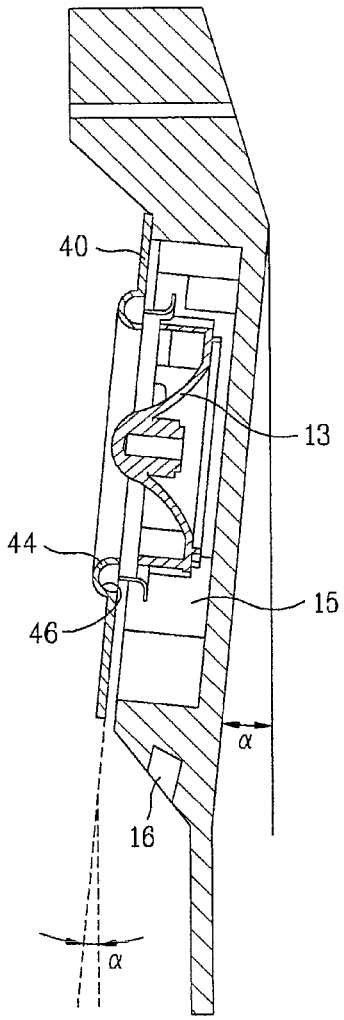
FIG. 5 is a cross section view illustrating another embodiment of a ventilation device.

FIG. 5 illustrates another embodiment. The bottom surface of the inside surface of the groove 46 of the annular rim 44 is famed to be inclined to the direction of the gravity to prevent formation of ice on the inside surface of the groove 46 of the annular rim 44. The cover 40 with the annular rim 44 is arranged to be inclined by a predetermined angel $\alpha°$ with respect to the vertical direction to ground. The angle $\alpha°$ is greater than zero from the vertical axis relative to ground and less than 45° . In this embodiment, the angle $\alpha°$ is between 0° and 40° . Based on such an inclination, the inside surface of the groove 46 is inclined to ground. The ventilation fan 13 and the scroll 15 are also inclined along the inclination of the annular rim 44. In this embodiment, the inclined portion 47 may or may not be included.

When the operation of a cooling cycle is stopped, water may condense in the groove 46 as well as inside of the scroll 15. A condensed water formed in the groove 46 of the annular rim 44 may not accumulate in the groove 46, and the inclination facilitates the flow of water to the inside of the scroll 15. Mainly due to gravity (with or without the inclined bottom portion 47), the water flows or falls to the bottom of scroll 15 where the drainage channel 16 is provided. The condensed water generated in the inside of the scroll 15 is discharged to the outside of the scroll 15 since drain channel 16 is arranged to be communicated from the inner bottom in the scroll 15 to the outside lower side of the scroll 15.

As described above, the cold air discharged from the ventilation fan 13 is guided by the 5 scroll 15 to flow to the first duct 12 and the second duct 14. The force acting on the cold air flowing along the inside surface of the scroll 15 can be divided into a vertical directional component force and a horizontal directional component. The drainage channel 16 is inclined to extend to the lower side, the inclination being in an opposite direction of the component forces. Based on such a configuration, there is substantially no risk of air leakage inside of scroll 15 through the drainage channel 16. Alternatively, the drainage channel 16 may be inclined to the direction of the gravitation, and may be formed to allow the force of air to easily push the condensed water to the drainage channel 16.

Another embodiment is disclosed in Korean Application No. 10-2007-0032113 filed Mar. 31, 2007, corresponding to U.S. patent application Ser. No. 12/058,480 filed Mar. 28, 2008, whose entire disclosures are incorporated herein by reference.

Disclosed herein is a ventilation device which may include a ventilation fan provided on an air flow channel and ventilating air by rotating about the axis of rotation; and an orifice guiding air to be flowed into the ventilation fan, a circumference member of the orifice being protruded to the outside in a substantially semi-circular form so that a groove is formed in the inside thereof in order to assist the inflow of the air, and capable of flowing down a condensed water without allowing the condensed water to collect in the groove.

The ventilation fan may comprise a plurality of blades arranged radially with respect to the axis of rotation, and a shroud formed in a ring form on an outer circumference surface of the circumference surface of the blade to guide the air.

The groove may comprise an inclination part inclined to the direction of gravity in order to be able to allow the condensed water to flow down. The inclination part may be formed on the bottom surface of the groove in the direction of gravity, and can be formed to allow the size of the area of the inclination part formed in the groove in proportional to the amount that the condensed water is formed to be different. The axis of rotation of the ventilation fan may be arranged in a direction substantially parallel with ground. The orifice may be inclined by a predetermined angle so that the bottom surface of the groove may be inclined to the direction of gravity, and the axis of rotation of the ventilation fan may be also inclined to the same direction by the inclined angle of the orifice.

Disclosed further herein is a condensed water drain channel facing the direction substantially opposite to the rotating direction of the ventilation fan in order to prevent the leakage of the air ventilated by means of the ventilation fan, and may be formed to be inclined downwardly so that the condensed water is drained by gravity.

A refrigerator comprising a ventilation device can comprise a duct having an evaporator; and a ventilation device for ventilating air cooled by means of the evaporator; wherein the ventilation device comprises: a ventilation fan ventilating the air flowing through the duct by rotating about the axis of rotation; and an orifice guiding air to be flowed into the ventilation fan, a circumference member of the orifice being protruded to the outside in a substantially semi-circular form so that a groove is formed in the inside thereof in order to assist the inflow of the air, and capable of flowing down a condensed water without allowing the condensed water to collect in the groove.

In another aspect, a refrigerator can comprise a duct having an evaporator; and a ventilation device for ventilating air cooled by means of the evaporator; wherein the ventilation device comprises a ventilation fan ventilating the air flowing through the duct by rotating about the axis of rotation; and a condensed water drain channel facing the direction substantially opposite to the rotating direction of the ventilation fan in order to prevent the leakage of the air ventilated by means of the ventilation fan, and formed to be inclined downwardly so that a condensed water is drained by gravity.

With the ventilation device and the refrigerator, a plurality of cold air channels such as a first duct and a second duct, may be communicated with the inside of the refrigerator so that the inside of the refrigerator can be uniformly cooled.

Since the condensed water is not collected in the groove of the orifice, ice is not generated at the corresponding portion so that the generation of noise and the change of the efficiency of the ventilation fan due to the change of the gap with the shroud of the ventilation fan do not occur, there is also substantially no risk that the ice contacts to the shroud of the ventilation fan so that reliability is improved.

Since the condensed water drain channel draining the condensed water in the scroll is formed in a direction opposite to the proceeding direction of the cold air discharged from the ventilation fan to flow in the inside of the scroll, the leakage of the cold air through the condensed water drain channel is prevented so that an overall efficiency is improved.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A ventilation device, comprising:

a fan configured to rotate about an axis of rotation; and an air guide providing an opening to the fan, a circumferential member of the air guide substantially surrounding the opening and having a groove, the groove having a predetermined profile, a predetermined shape, and a predetermined angle from a vertical axis to allow condensed water to flow off of the groove, wherein the groove has a semi-circular cross-sectional shape, and wherein when the predetermined angle of the groove is zero, the groove comprises an extended portion that extends down from a bottom of the groove at an angle greater or less than 90° with respect to a horizontal plane so as to allow condensed water to flow off of the groove without stagnating the condensed water in the bottom of the groove.

2. The ventilation device as claimed in claim 1, wherein the fan comprises:

a hub;

a shroud having a ring shape; and a plurality of blades arranged radially with respect to the axis of rotation and coupled to the hub and the shroud.

3. The ventilation device as claimed in claim 2, further comprising a scroll that guides air discharged from the fan and a cover that covers the scroll, wherein the cover includes the air guide providing the opening to the fan.

4. The ventilation device as claimed in claim 3, wherein the circumferential member is formed by an annular rim of a portion of the cover corresponding to the fan, and wherein an inner circumferential surface of the annular rim faces the shroud of the fan and surrounds a protruded portion of the shroud of the fan.

5. The ventilation device as claimed in claim 4, wherein the groove is formed by the inner circumferential surface of the annular rim that curves inward substantially in a semi-circular form to form the groove.

6. The ventilation device as claimed in claim 1, wherein the extended portion is formed on a bottom surface of the groove and extends in a direction of gravity.

7. The ventilation device as claimed in claim 6, wherein a size of an area of the extended portion is proportional to an amount of water condensation.

8. The ventilation device as claimed in claim 7, wherein the axis of rotation of the fan is arranged in a direction substantially parallel to the ground.

9. The ventilation device as claimed in claim 1, further comprising a water drain channel that faces a direction substantially opposite to a rotating direction of the fan, and which is inclined downward such that the water is drained by gravity through the water drain channel.

10. The ventilation device as claimed in claim 9, wherein the water drain channel extends in a direction substantially opposite to a direction in which cold air is discharged from the fan, thereby preventing leakage of the cold air through the water drain channel.

11. A ventilation device, comprising:

a fan configured to rotate about an axis of rotation;

an air guide providing an opening to the fan, a circumferential member of the air guide substantially surrounding the opening and having a groove, the groove having a predetermined profile, a predetermined shape, and a predetermined angle from a vertical axis to allow condensed water to flow off of the groove, wherein the air guide is inclined by a predetermined angle of greater than approximately 0° from the vertical axis relative to the ground and less than approximately 45° so that a bottom surface of the groove is inclined with respect to a direction of gravity, and the axis of rotation of the fan is also inclined in the same direction by the predetermined angle of the air guide so as to allow condensed water to flow off of the groove without stagnating in a bottom of the groove; and a water drain channel that faces a direction substantially opposite to a rotating direction of the fan, and which is inclined downward such that the condensed water flowing from the groove is drained by gravity through the water drain channel.

12. A refrigerator, comprising:

an air cooling device;

a ventilation device that ventilates air cooled by the air cooling device, wherein the ventilation device comprises a fan configured to rotate about an axis of rotation; and an air guide providing an opening to the fan, a circumferential member of the air guide substantially surrounding the opening and having a groove, the groove having a predetermined profile, a predetermined shape, and a predetermined angle from a vertical axis to allow condensed water to flow off of the groove, wherein the groove has a semi-circular cross-sectional shape, and wherein when the predetermined angle of the groove is zero, the groove comprises an extended portion that extends down from a bottom of the groove at an angle greater or less than 90° with respect to a horizontal plane so as to allow condensed water to flow off of the groove without stagnating in the bottom of the groove.

13. The refrigerator as claimed in claim 12, wherein the fan comprises:

a hub;

a shroud having a ring shape; and a plurality of blades arranged radially with respect to the axis of rotation and coupled to the hub and the shroud.

14. The refrigerator as claimed in claim 12, wherein the extended portion is formed on a bottom surface of the groove and extends in a direction of gravity.

15. The refrigerator as claimed in claim 14, wherein a size of an area of the extended portion is proportional to an amount of water condensation.

16. The refrigerator as claimed in claim 15, wherein the axis of rotation of the fan is arranged in a direction substantially parallel to the ground.

17. The refrigerator as claimed in claim 12, further comprising a water drain channel that faces a direction substantially opposite to a rotating direction of the fan, and formed to be inclined downward such that the water is drained by gravity through the water drain channel.

18. The refrigerator as claimed in claim 17, wherein the water drain channel extends in a direction substantially opposite to a direction in which cold air is discharged from the fan, thereby preventing leakage of the cold air through the water drain channel is prevented.

19. A refrigerator, comprising:

an air cooling device;

a ventilation device that ventilates air cooled by the air cooling device, wherein the ventilation device comprises a fan configured to rotate about an axis of rotation; and an air guide providing an opening to the fan, a circumferential member of the air guide substantially surrounding the opening and having a groove, the groove having a predetermined profile, a predetermined shape, and a predetermined angle from a vertical axis to allow condensed water to flow off of the groove, wherein the air guide is inclined by a predetermined angle of greater than approximately 0° from a vertical axis relative to the ground and less than approximately 45° so that a bottom surface of the groove is inclined in a direction of gravity, and the axis of rotation of the fan is also inclined in the same direction by the predetermined angle of the air guide so as to allow condensed water to flow off of the groove without stagnating in the bottom of the groove; and a water drain channel that faces a direction substantiality opposite to a rotating direction of the fan, and which is inclined downward such that the condensed water flowing from the groove is drained by gravity though the water drain channel.

20. A refrigerator, comprising:

a housing having a door configured to open and close, at least one compartment to allow storage of an item to be cooled or frozen;

a machine compartment that houses cooling components;

a ventilation device that circulates air cooled by the cooling components; and at least one duct that guides the air from the ventilation device, wherein the ventilation device comprises:

a fan configured to rotate about an axis of rotation; and an air guide providing an opening to the fan, an annular rim forming the opening to the fan and having a groove of a predetermined profile, a predetermined shape, and a predetermined angle from a vertical axis to allow condensed water to flow off of the groove, wherein the fan comprises:

a hub;

a shroud of annular shape; and a plurality of blades arranged radially with respect to the axis of rotation and coupled to the hub and the shroud, wherein the groove has a semi-circular cross-sectional shape, and wherein when the predetermined angle of the groove is zero, the groove comprises an extended portion that extends down from a bottom of the groove at an angle greater or less than 90° with respect to a horizontal plane so as to allow condensed water to flow off of the groove without stagnating in the bottom of the groove.

* * * * *